US006484451B1

(12) United States Patent
Gavin

(10) Patent No.: US 6,484,451 B1
(45) Date of Patent: Nov. 26, 2002

(54) STACKABLE RISER RESISTANT TO SOIL MOVEMENT

(75) Inventor: Norman Gavin, Wallingford, CT (US)

(73) Assignee: United Concrete Products, Inc., Yalesville, CT (US)

( * ) Notice: Subject to any disclaimer, the term of this patent is extended or adjusted under 35 U.S.C. 154(b) by 0 days.

(21) Appl. No.: 09/766,795

(22) Filed: Jan. 22, 2001

(51) Int. Cl.[7] ..... E02D 29/12

(52) U.S. Cl. ..... 52/20; 52/19; 52/98; 220/4.03; 220/4.26; 404/25

(58) Field of Search ..... 52/19, 20, 98, 52/100, 141, 169.6; 220/4.03, 4.26; 174/37, 39; 404/25; 405/41, 80, 83, 134, 136, 137

(56) References Cited

U.S. PATENT DOCUMENTS

| | | | | | |
|---|---|---|---|---|---|
| 871,977 | A | | 11/1907 | Winslow | |
| 3,385,012 | A | * | 5/1968 | Lovegreen | 52/21 |
| 3,772,826 | A | | 11/1973 | Ferver | |
| 4,852,757 | A | * | 8/1989 | Gold | 220/4.03 |
| 5,366,317 | A | * | 11/1994 | Solimar | 404/25 |
| 5,386,669 | A | * | 2/1995 | Almeida | 52/19 |
| 5,513,926 | A | * | 5/1996 | Prescott | 404/26 |
| 5,542,780 | A | * | 8/1996 | Kourgli | 405/55 |
| 5,617,679 | A | | 4/1997 | Meyers | |
| 5,653,559 | A | * | 8/1997 | Stieb et al. | 52/20 X |
| 5,852,901 | A | | 12/1998 | Meyers | |
| 6,195,944 | B1 | * | 3/2000 | Goldthorpe | 52/19 |
| 6,088,972 | A | * | 7/2000 | Johanneck | 52/100 |

* cited by examiner

*Primary Examiner*—Carl D. Friedman
*Assistant Examiner*—Brian E. Glessner
(74) *Attorney, Agent, or Firm*—Jenner & Block, LLC

(57) ABSTRACT

A stackable riser having a substantially smooth outer surface has a first open end defined by an edge and a second open end defined by a pair of adjacent channels, so that the edge defining the first open end of a first riser can mate with one of the channels defining the second open end of a second riser. A detachable anchor tab extends radially from the outer surface about the circumference of the riser. A plurality of risers can be stacked one on top of another, with, for example, the bottommost riser embedded in concrete and the risers above it embedded in soil. Preferably, the anchor tab of the bottommost riser remains attached to the riser and the anchor tab of the risers above it is removed.

55 Claims, 4 Drawing Sheets

STACKABLE RISER RESISTANT TO SOIL MOVEMENT

BACKGROUND OF THE INVENTION

1. Field of the Invention

The present invention pertains to stackable risers. More particularly, the present invention pertains to a system and method of connecting a series of risers in a way that provides improved vertical support, minimizes the effect of frost heaving and other forces due to vertical ground movement, and resists rotational forces resulting from lateral ground movement.

2. Background of the Invention

Meters, splices, junction boxes, and other components of buried utility systems are often located inside hand-holes or manholes to enable easy access by utility workers from aboveground. Often, utility systems provide such access facilities at key points, such as a major bend in an underground cable/conduit run or location of water or gas meters and other equipment subject to frequent servicing or inspection. Such access facilities have been constructed using preformed or poured concrete side retaining walls. Concrete can be expensive, particularly where the application requires a non-standard size or length, in which case setting forms and pouring concrete adds time and expense. Also, over time, the concrete can crack due to forces caused, for example, by freezing and thawing or by heavy vehicles being driven over the top of the manhole. Tiled sidewalls and concrete block are examples of other labor intensive alternatives.

Injection molded, plastic, stackable risers made of high density polyethylene and other rigid, light weight polymeric material are known in the art and provide a less expensive, standardized alternative that lends itself to rapid on site customization. Risers can be manufactured in various heights and diameters and a series of identically sized risers can be stacked to achieve a desired depth.

Depending on the soil characteristics and overhead traffic, the vertical, horizontal, and rotational forces placed upon these risers can be considerable. A major shortcoming of plastic risers lies in their tendency to deform or break when subjected to such forces. The use of vertical and horizontal strengthening ribs to alleviate this tendency is common. When placed along the exterior of the sidewall, however, these reinforcing ribs themselves often are subjected to the same vertical and horizontal forces they are intended to protect against.

U.S. Pat. No. 5,852,901 for a "Stackable Riser for On-Site Waste and Drainage Systems," issued to Meyers illustrates one prior art design of a plastic riser for forming a depth-adjustable, grade-level access for underground components. The Meyers riser forms a rigid structure intended to support heavy loads applied to the grade level access lid. Identical risers reinforced along portions of both the inner and outer walls are stacked one on top of the other utilizing a single tongue and groove connection. A horizontal rib extending outward along the circumference of the external surface of the side wall of each cylindrical riser and a plurality of vertical ribs, also on the external surface of the riser, individually anchor each riser in the ground. A plurality of risers can be stacked to form a vertical, air-tight, liquid-tight, and gas-tight riser and lid system.

The shifting of the ground surrounding the riser stack disclosed in the Meyers patent can twist and move the stacked risers, knocking them out of alignment. Eventually, the shifting can lead to rupture of the stacked risers' sidewall. The presence of external horizontal and vertical reinforcing ribs extending along the wall of each riser, while strengthening the riser sidewalls, also exacerbates this problem because shifting soil applies force against each exposed rib. The configuration of the tongue and groove arrangement of the risers disclosed in the Meyers patent also precludes the placement of supporting ribs along the full vertical length of the interior riser wall, which lessens the sidewall's resistance to forces exerted by the shifting of the soil abutting the sidewalls and external ribs.

SUMMARY OF INVENTION

The stackable riser of the present invention addresses these shortcomings. In the preferred embodiment, the stackable riser of the present invention has a hollow, cylindrical configuration, although configurations other than cylindrical may be used. The sidewall of the riser includes a channel end and a tapered end. In the preferred embodiment, the riser has a nearly smooth exterior surface from which projects outwardly a detachable anchor tab that may run along substantially the full circumference of the riser. The channel end of the riser sidewall includes two adjoining channels which are defined by interior, middle, and exterior walls that project concentrically with, or (in the case of risers having, for example, a square or rectangular cross-section) parallel to, the sidewall. The opposite, or tapered, end of the riser sidewall terminates in a portion tapered to a narrower thickness at the end. A plurality of vertical reinforcing ribs are spaced around the interior surface of the cylindrical sidewall of the riser. Because in the preferred embodiment the ribs extend from near the channel end to the distal end of the tapered end of the riser sidewall, they strengthen the sidewall in the area of the joint between each pair of stacked risers. In the preferred embodiment, the interior surface of the sidewall also includes at least one boss extending vertically from near the channel end to the distal end of the tapered end of the riser. Each boss is adapted to receive a screw, or other fastener, for securing another riser stacked on top of the first riser, or a cover at ground level.

The tapered end of the riser sidewall is configured to mate with the two concentric channels of either another riser or a cover. The radially outer channel is shallower than the inner channel in the preferred embodiment and accepts the tapered end of the sidewall of another riser on which it is placed. The radially inner channel is wider than the outer channel, and accepts the interior vertical support ribs and bosses of a riser on which it rests. An O-ring placed in the outer channel can be used to effect a water-tight and gas-tight seal between two stacked riser sections (or between a riser and a cover). Sealant can be applied to the area where the tapered end of a first riser contacts the outer channel of another riser (or a cover) stacked on top of the first riser to further ensure a water-tight, gas-tight seal between adjacent risers (or between a riser and a cover) beyond that provided by the dual channel design of the present invention.

In the preferred embodiment, a detachable anchor tab on the exterior surface of the riser sidewall serves to anchor the lower-most riser in concrete, for example, a cast-in-place concrete distribution box. The concrete is poured around the riser and its anchor tab, thereby anchoring the bottom riser after the concrete hardens. Another identical riser may be placed on top of the bottom riser, with the tapered end of the bottom riser mating with the channel end of the riser placed on top of the bottom riser. The anchor tab on each of the risers stacked above the bottom riser (i.e., above the riser anchored in the concrete box) in a given stack can be detached by tearing it away from the exterior of the sidewall. In the preferred embodiment, the anchor tab includes a handle for this purpose. Tearing away the anchor tabs on the risers that are not anchored in concrete gives the stack of risers a nearly smooth exterior surface, thereby minimizing the forces exerted on the stack of risers by movement of the soil in contact with the riser stack.

In alternative embodiments of the present invention, the risers may have a square, rectangular, elliptical or other cross-sectional configuration.

It is an object of the present invention to provide an improved connection configuration that resists rotational forces exerted on one or more risers in an interconnected system.

It is another object of the present invention to provide improved reinforcement of the sidewalls of risers stacked one on top of the other.

It is still another object of the present invention to provide a detachable anchor on the exterior surface of a riser, the anchor being used when the riser is to be anchored in concrete, and removed when the riser is to be in contact with soil.

It is a further object of the present invention to provide a riser adapted for being anchored in concrete, while at the same time minimizing the susceptibility of a stack of risers to forces caused by the ground next to the stack shifting.

Other features, objects and advantages of the invention will become apparent from the following description and drawings in which the details of the invention are fully and completely disclosed as part of this specification.

DETAILED DESCRIPTION OF THE PREFERRED EMBODIMENT

Figure 2:
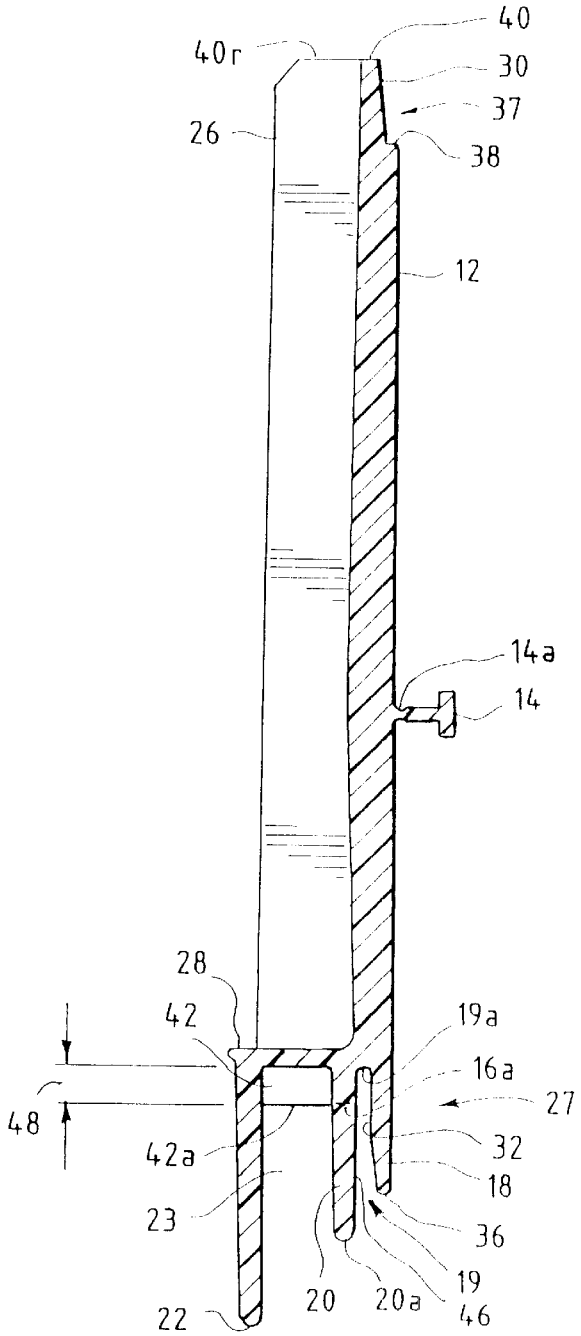
FIG. 2 is a cross-section view of the stackable riser of the present invention taken along line 2—2 in FIG. 1.
Figure 3:
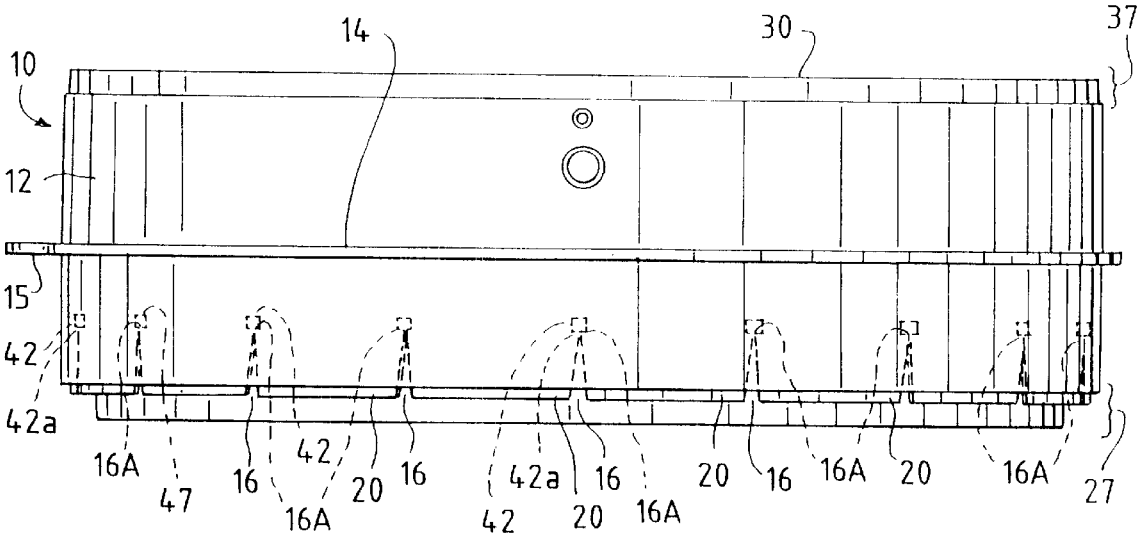
FIG. 3 is a side view of a cylindrical stackable riser of the present invention.
Figure 4:
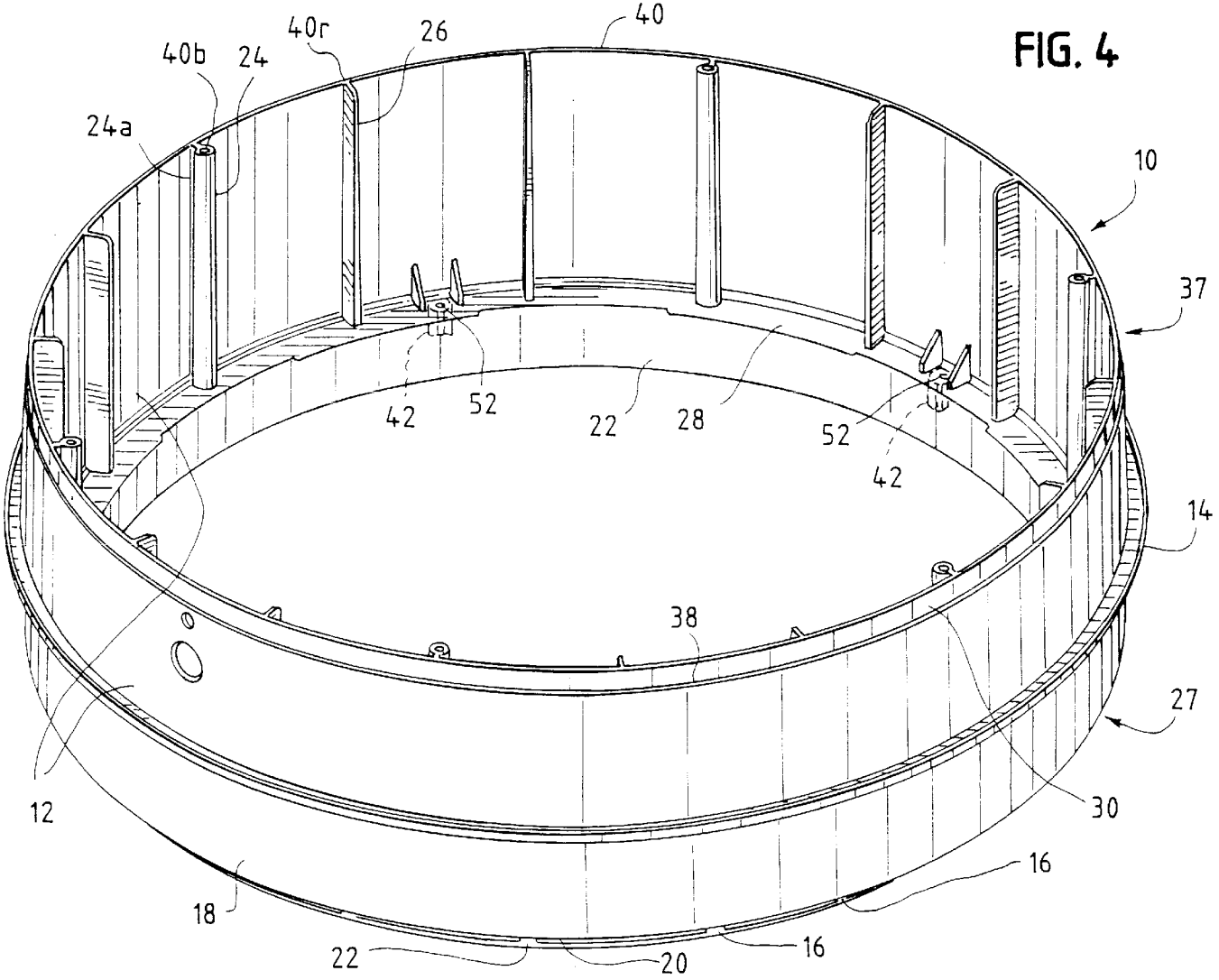
FIG. 4 is perspective view of a cylindrical stackable riser of the present invention.

Referring to FIGS. 1, 2, 3 and 4, in the preferred embodiment of the present invention a stackable riser 10 includes sidewall 12 having a plurality of vertical bosses 24 and a plurality of vertical reinforcing ribs 26. Attached to the substantially smooth exterior surface of sidewall 12 is detachable anchor tab 14 (discussed below). Sidewall 12 has a tapered end 37 and a channel end 27. (In an alternative embodiment, end 37 could be straight rather than tapered.) In the preferred embodiment, tapered end 37 includes on the external surface of sidewall 12 a horizontal edge surface 38 (i.e., edge surface 38 is substantially perpendicular to the axis of the riser and the external face of sidewall 12). With reference to FIG. 4, edge surface 38 extends around the circumference of sidewall 12. End 37 includes a tapered portion 30 extending from horizontal edge surface 38 to the distal end of tapered end 37 of sidewall 12 and riser 10. End 37 of riser 10 includes the ends 40*b* and 40*r* of vertical bosses 24 and ribs 26, respectively, the ends 40*b*, 40*r* being flush with the horizontal edge 40 on the end of tapered portion 30 of sidewall 12. Tapered end 37 thereby forms a unique male connector. The opposite end of riser 10 forms a corresponding female connector, referred to herein as channel end 27, as described below.

Figure 1:
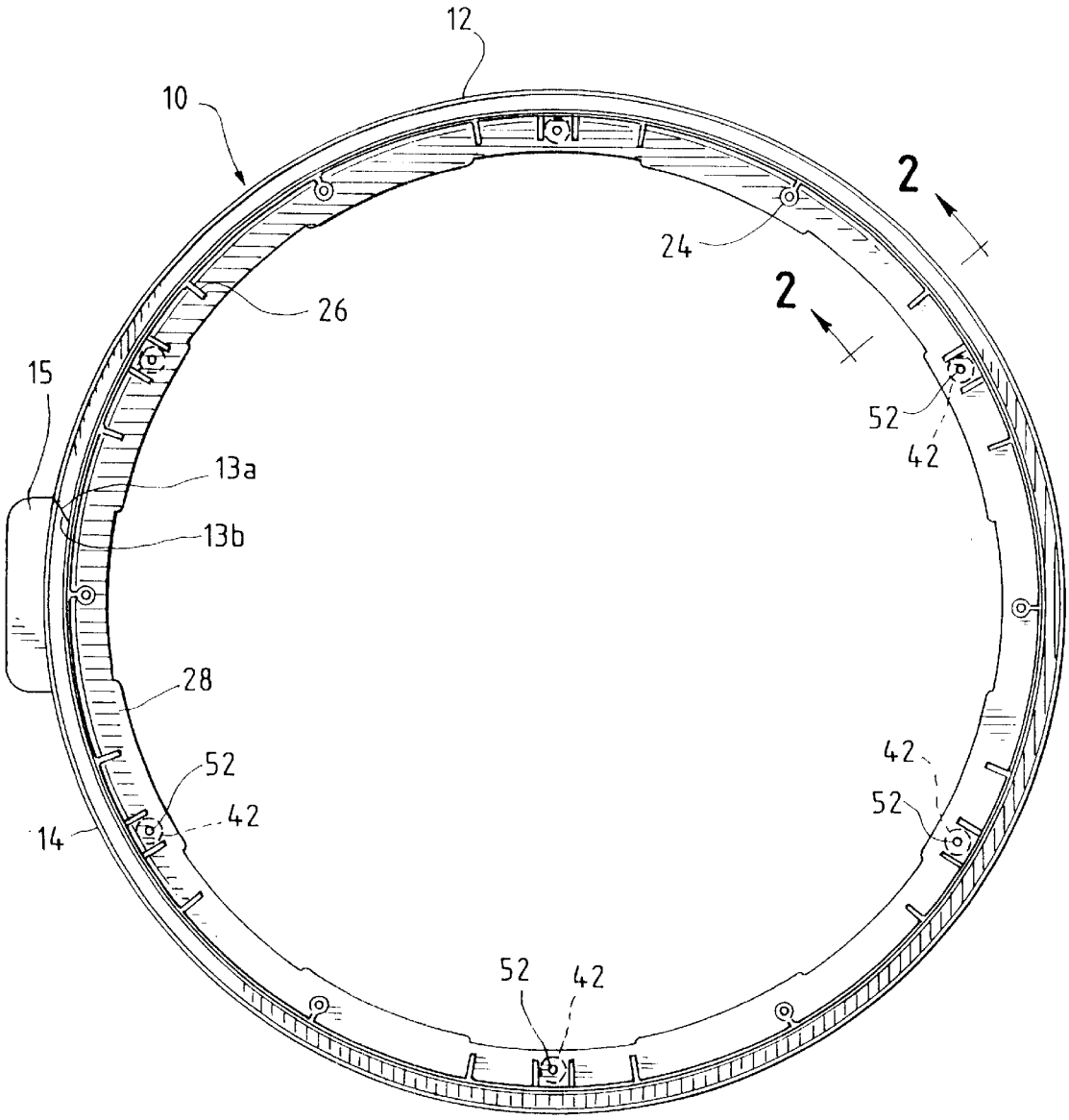
FIG. 1 is a top view of a cylindrical stackable riser of the present invention.
Figure 2A:
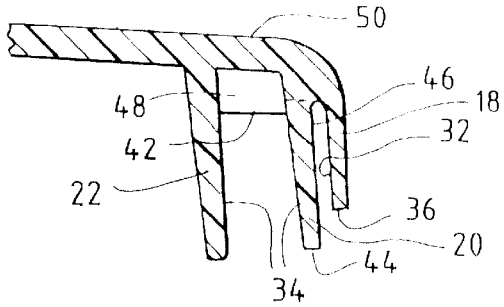
FIG. 2A is a cross-section view of a cover for overlying a stackable riser of the present invention.

Referring to FIGS. 2, 3 and 4, the channel end 27 of riser 10 comprises a unique dual channel arrangement in which outer wall 18, middle wall 20, and inner wall 22 extend downward from, and are generally parallel to, sidewall 12. Horizontal ledge 28 on the interior surface of sidewall 12 (see FIGS. 1, 2 and 4) is generally perpendicular to sidewall 12. As shown in FIGS. 2 and 4, bosses 24 and ribs 26 extend vertically from ledge 28 to the distal end 40 of tapered end 37. Bosses 24 are attached to or formed on the interior surface of sidewall 12 by an offsetting portion 24*a* (see FIG. 4) that extends from the inside surface of sidewall 12 to the boss 24. The relatively narrow width of slots 16 in middle wall 20, as shown in FIGS. 3 and 4, substantially limits any rotation of riser 10 with respect to another riser 10 stacked above or below the first riser because the offsetting portions 24*a* of bosses 24 and the ribs 26 pass through and are restricted against angular lateral movement by the sides of slots 16. The top surfaces 40*b* of offsetting portions 24*a* and bosses 24 and top surfaces 40*r* of ribs 26 are flush with the top surface 40 of tapered end 37. Referring to FIG. 2, when the tapered end 37 of one riser 10 and channel end 27 of another riser 10 are mated, top edge 40 of tapered portion 30 is positioned within outer channel 19, which is the channel or space between inner surface 32 of outer wall 18 and outer surface 46 of middle wall 20. Bottom edge 36 of outer wall 18 thus rests upon edge 38 on the exterior surface of sidewall 12.

As shown in FIGS. 2–4, channel end 27 of the present invention includes middle wall 20 having slots 16 at regular intervals. The slots 16 are spaced in middle wall 20 of a first riser 10 such that they align with offsetting portions 24*a* of bosses 24 and with ribs 26 of an end 37 of a second riser 10 when the first riser is placed on top of the second riser. Bosses 24 and ribs 26 of the second riser 10 thereby extend into inner channel 23 of the first riser 10. With reference to FIGS. 2 and 3, each slot 16 extends from end 20*a* of wall 20 to top 16*a*. The top 16*a* of each slot 16 is flush with the end 42*a* of a vertical projection 42 in inner channel 23. Each projection 42 (shown partially by the phantom lines in FIG. 3) projects into outer channel 23 a height indicated by line 48 (see FIG. 2). Offsetting portions 24*a* of bosses 24 and supporting ribs 26 of a first riser are adapted to slide into slots 16 in a second riser when the second riser is placed on top of the first riser. In a preferred embodiment, slots 16 and corresponding projections 42 are spaced midway between bosses 24 and ribs 26, which increases the structural integrity of the riser 10. In one embodiment, a riser is rotated 15° with respect to a riser above or below it in a stack. Additional risers 10 can be stacked above or below the first and second risers, as desired.

When one riser is placed on top of another, top edge 40 of the riser on the bottom projects into outer channel 19. In the preferred embodiment, an O-ring (not shown) is positioned at the bottom 19*a* of outer channel 19 such that when the first riser is placed on top of a second riser top edge 40 of tapered end 37 abuts against the O-ring (not shown) to provide a substantially water-tight and gas-tight seal. The height 48 of projecting members 42 is such that the top edges 42*a* of projecting members 42 abut against edges 40*b* and 40*r* of bosses 24 and ribs 26, respectively, of the second riser. Accordingly, sidewalls 12 are reinforced along the full height of sidewall 12 by the combined height of projections 42 and either bosses 24 or ribs 26. Outer wall 18 and middle wall 22 prevent horizontal movement of two stacked risers 10 with respect to each other.

In the preferred embodiment, vertical support bosses 24 are cylindrical in shape and, as noted above, are attached to the interior surface of sidewall 12 by connecting member or offsetting portion 24*a*, which preferably runs along the full vertical height of each boss 26. As shown in FIG. 3, when two risers 10 are placed one on top of the other, slot 16 can accept either, referring now to FIG. 2, top edge 40*r* of a rib 26 or top edge 40*b* of offsetting portion 24*a* of a boss 24.

The vertical bosses 24 each contain on their end 40*b* a hollow bore adapted to accept a screw, or other suitable fastener. Similarly, each projection 42 in a first riser 10 that is aligned with a boss 24 of a second riser 10 may contain such a hollow bore (not shown) so that a screw or other suitable fastener (not shown) can be inserted through projection 42 in the first riser 10 into the top end of a boss 24 below it in a second riser 10 to thereby fasten the two risers together. In that case, ledge 28 contains an opening 52 over the projections 42 having the hollow bores (not shown) so that a screw or other fastener may be inserted through projection 42 and into the top end 40*b* of boss 24 below it when two risers 10 are stacked. A lid 50 (see FIG. 2A) can cover the uppermost riser 10 in a stack of risers 10. The lid 50 may have the same configuration as the channel end of risers 10 and may include projections 42 having hollow bores for accepting screws or other fasteners as described above for fastening two risers 10 together.

Alternatively, the tapered ends 37 could be on the bottom and the channel ends could be on the top in a stack of risers 10 of the present invention. In this configuration, the lid 50 has an end with the same configuration as tapered end 37 of risers 10.

Referring to FIGS. 1, 2 and 3, detachable anchor tab 14 runs along the outside surface of the sidewall 12. The bottom-most riser 10 within a vertical stack may be cast in concrete (e.g., a concrete distribution box not shown), in which case anchor tab 14 serves to anchor the bottom-most riser 10 within the concrete. In the preferred embodiment, pull handle 15 is attached near ends 13*a*, 13*b* of anchor tab 14. Anchor tab 14 is severed or has a weakened cross-section at ends 13*a*, 13*b* such that pulling on handle 15 in a radial direction separates ends 13*a* and 13*b*. Preferably, anchor tab 14 is attached to the outside of sidewall 12 by a weakened region 14*a*, such that continuing to pull handle 15 away from the sidewall 12 causes anchor tab 14 to tear away form the outside surface of riser 10 in region 14*a*. Anchor tab 14 is preferably completely removed from riser 10 when riser 10 is not intended to be cast in concrete. Detaching anchor tab 14 from each of the risers placed above the bottom-most riser (i.e., all of the risers except the bottom one that is cast in concrete) enhances the stability of the entire stack by providing a substantially smooth external surface that is less susceptible to forces caused by ground heaving and shifting than if the external surface contained the anchor tabs 14 (or any other projecting elements, such as support ribs). In this way, the alignment and integrity of the overall riser stack is maintained in areas subject to soil movement caused by freezing and thawing or heavy traffic over the top of the riser.

Whereas the present invention is described herein with respect to specific embodiments thereof, it will be understood that various changes and modifications may be made by one skilled in the art without departing from the scope of the invention, and it is intended that the invention encompass such changes and modifications as fall within the scope of the appended claims.

What is claimed is:

1. A stackable riser forming a passageway there through, comprising:

a continuous side wall having an open first end portion facing in a first direction, an open second end portion facing in a second direction opposite from said first direction, an intermediate portion interconnecting said first and second end portions, and an inner surface and an outer surface;

a shoulder on the outer surface of said side wall, said shoulder facing in said first direction and being spaced from said first end portion, wherein said outer surface includes a recess between said shoulder and said first end portion, said shoulder and said recess being shaped to receive the side wall of the second end portion of another riser;

a channel on said second end portion, said channel being defined by said side wall and a middle wall member attached to said side wall, said middle wall member being spaced from said inner surface of said side wall, and said channel being shaped to receive a first end portion of another riser; and an anchor tab detachably attached to said outer surface of said side wall, said anchor tab protruding outwardly away from the riser and being adapted for being embedded in surrounding material.

2. A riser as claimed in claim 1 wherein said outer surface of said side wall is substantially smooth between said shoulder and said second end portion when said anchor tab is detached.

3. A riser as claimed in claim 1 further comprising a plurality of reinforcing ribs on said inner surface of said side wall, said reinforcing ribs being substantially parallel to said first and second directions, and said reinforcing ribs extending to said first end portion.

4. A riser as claimed in claim 3 wherein said middle wall member defines a plurality of notches, said notches being shaped to allow the reinforcing ribs of another riser to pass through them.

5. A stackable riser forming a passageway there through comprising:

a continuous side wall having an open first end portion facing in a first direction, an open second end portion facing in a second direction opposite from said first direction, an intermediate portion interconnecting said first and second end portions, and an inner surface and an outer surface;

a plurality of reinforcing ribs on said inner surface of said side wall, said reinforcing ribs being substantially parallel to said first and second directions, and said reinforcing ribs extending to said first end portion;

a shoulder on the outer surface of said side wall, said shoulder facing in said first direction and being spaced from said first end portion, wherein said outer surface includes a recess between said shoulder and said first end portion, said shoulder and said recess being shaped to receive the side wall of the second end portion of another riser;

a channel on said second end portion, said channel being defined by said side wall and a middle wall member attached to said side wall, said middle wall member being spaced from said inner surface of said side wall and defining a plurality of notches, said notches being shaped to allow the reinforcing ribs of another riser to pass through them, and said channel being shaped to receive a first end portion of another riser; and an anchor tab detachably attached to said outer surface of said side wall, said anchor tab protruding outwardly away from the riser and being adapted for being embedded in surrounding material.

6. A stackable riser section comprising:

a sidewall defining an essentially smooth outer surface;

an upper end of said sidewall adapted to mate with a lower end of the sidewall of another riser section;

a lower end of said sidewall adapted to mate with the upper end of another riser section, wherein said essentially smooth outer surface of said sidewall includes a removable anchor tab extending therefrom.

7. A stackable riser section as claimed in claim 6 wherein said lower end includes walls defining at least one channel to receive an upper end of another riser section, and wherein said upper end is adapted to be received in the at least one channel of another riser section.

8. A stackable riser section as claimed in claim 6 wherein said removable anchor tab includes a weakened cross section attaching ends thereof together and a weakened region attaching said removable anchor tab to said sidewall.

9. A stackable riser as claimed in claim 8 wherein said removable anchor tab includes a pull handle near said ends.

10. A stackable riser section as claimed in claim 9 wherein said riser section is generally cylindrical and said anchor tab extends horizontally outward from said sidewall.

11. A stackable riser section as claimed in claim 7 wherein said channel end includes walls defining said at least one channel and a second channel, and wherein a plurality of vertical bosses and vertical ribs extend along the inner surface of said sidewall, said second channel of said riser section being adapted to receive the bosses and ribs of another riser section.

12. A stackable riser section as claimed in claim 11 wherein said channel end includes a horizontal ledge, said ledge includes a plurality of vertical projections in said second channel, said projections positioned to align with the bosses and ribs of another riser section.

13. A stackable riser section as claimed in claim 12 wherein a wall defining said second channel end includes notches aligned with said vertical projections, said bosses include offsetting portions connecting said bosses to said inner surface of said sidewall, and said notches are sized to receive the offsetting portions of the bosses and ribs of another riser section.

14. A stackable riser section as claimed in claim 13 wherein said horizontal ledge and said vertical projections adapted to align with the bosses of another riser section include openings defining a hollow bore to receive a fastener to secure said riser section to another riser section disposed with the offsetting portions of its bosses and ribs received in said second channel.

15. A stackable riser as claimed in claim 13 wherein said notches are sized to prevent relative rotational movement of stacked riser section.

16. A stackable riser section as claimed in claim 14 wherein said notches are sized to prevent relative rotational movement of stacked riser sections.

17. A stackable riser section as claimed in claim 15 wherein said sidewall is generally cylindrical.

18. A stackable riser section as claimed in claim 7 wherein said upper end is a tapered end, said tapered end is adapted to be positioned in said at least one channel of another riser section.

19. A stackable riser section as claimed in claim 11 wherein said upper end is a tapered end, said tapered end is adapted to be positioned in said at least one channel of another riser section.

20. A stackable riser section as claimed in claim 12 wherein said upper end is a tapered end, said tapered end is adapted to be positioned in said at least one channel of another riser section.

21. A stackable riser section as claimed in claim 13 wherein said upper end is a tapered end, said tapered end is adapted to be positioned in said at least one channel of another riser section.

22. A stackable riser section as claimed in claim 14 wherein said upper end is a tapered end, said tapered end is adapted to be positioned in said at least one channel of another riser section.

23. A stackable riser section as claimed in claim 15 wherein said upper end is a tapered end, said tapered end is adapted to be positioned in said at least one channel of another riser section.

24. A stackable riser section as claimed in claim 12 wherein said vertical projections on said horizontal ledge are disposed midway between adjacent bosses and ribs of said riser section.

25. A stackable riser section as claimed in claim 13 wherein said vertical projections on said horizontal ledge are disposed midway between adjacent bosses and ribs of said riser section.

26. A stackable riser section as claimed in claim 14 wherein said vertical projections on said horizontal ledge are disposed midway between adjacent bosses and ribs of said riser section.

27. A stackable riser section as claimed in claim 15 wherein said vertical projections on said horizontal ledge are disposed midway between adjacent bosses and ribs of said riser section.

28. A stackable riser section as claimed in claim 16 wherein said vertical projections on said horizontal ledge are disposed midway between adjacent bosses and ribs of said riser section.

29. A stackable riser section as claimed in claim 17 wherein said vertical projections on said horizontal ledge are disposed midway between adjacent bosses and ribs of said riser section.

30. A stackable riser section as claimed in claim 20 wherein said vertical projections on said horizontal ledge are disposed midway between adjacent bosses and ribs of said riser section.

31. A stackable riser section as claimed in claim 21 wherein said vertical projections on said horizontal ledge are disposed midway between adjacent bosses and ribs of said riser section.

32. A stackable riser section as claimed in claim 22 wherein said vertical projections on said horizontal ledge are disposed midway between adjacent bosses and ribs of said riser section.

33. A stackable riser section as claimed in claim 23 wherein said vertical projections on said horizontal ledge are disposed midway between adjacent bosses and ribs of said riser section.

34. A stackable riser section comprising:

a sidewall;

a first end of said sidewall adapted t mate with a lower end of the sidewall of another riser section;

a second end of said sidewall adapted to mate with the upper end of another riser section, one of said ends is a channel end and includes walls defining a first and second channel, said first channel adapted to receive a first end of another riser section, and wherein said first end is adapted to be received in said first channel of another riser section, wherein a plurality of vertical members extend along an inner surface of said sidewall, said second channel of said riser section being adapted to receive the vertical members of another riser section.

35. A stackable riser section as claimed in claim 34 wherein said vertical members comprise a plurality of vertical bosses and vertical ribs extending along the inner surface of said sidewall, said second channel of said riser section being adapted to receive the bosses and ribs of another riser section.

36. A stackable riser section as claimed in claim 35 wherein said channel end includes a horizontal ledge, said ledge includes a plurality of vertical projections in said second channel, said projections positioned to align with the bosses and ribs of another riser section.

37. A stackable riser section as claimed in claim 36 wherein a wall defining said second channel end includes notches aligned with said vertical projections, said bosses include offsetting portions connecting said bosses to said inner surface of said sidewall, and said notches are sized to receive the offsetting portions of the bosses and ribs of another riser section.

38. A stackable riser section as claimed in claim 37 wherein said horizontal ledge and said vertical projections adapted to align with the bosses of another riser section include openings defining a hollow bore to receive a fastener to secure said riser section to another riser section disposed with the offsetting portions of its bosses and ribs received in said second channel.

39. A stackable riser as claimed in claim 38 wherein said notches are sized to prevent relative rotational movement of stacked riser sections.

40. A stackable riser section as claimed in claim 39 wherein said notches are sized to prevent relative rotational movement of stacked riser sections.

41. A stackable riser section as claimed in claim 40 wherein said sidewall is generally cylindrical.

42. A stackable riser section as claimed in claim 35 wherein said first end is a tapered end, said tapered end is adapted to be positioned in said at least one channel of another riser section.

43. A stackable riser section as claimed in claim 36 wherein said first end is a tapered end, said tapered end is adapted to be positioned in said at least one channel of another riser section.

44. A stackable riser section as claimed in claim 37 wherein said first end is a tapered end, said tapered end is adapted to be positioned in said at least one channel of another riser section.

45. A stackable riser section as claimed in claim 38 wherein said first end is a tapered end, said tapered end is adapted to be positioned in said at least one channel of another riser section.

46. A stackable riser section as claimed in claim 34 wherein said vertical projections on said horizontal ledge are disposed midway between adjacent bosses and ribs of said riser section.

47. A stackable riser section as claimed in claim 36 wherein said vertical projections on said horizontal ledge are disposed midway between adjacent bosses and ribs of said riser section.

48. A stackable riser section as claimed in claim 37 wherein said vertical projections on said horizontal ledge are disposed midway between adjacent bosses and ribs of said riser section.

49. A stackable riser section as claimed in claim 38 wherein said vertical projections on said horizontal ledge are disposed midway between adjacent bosses and ribs of said riser section.

50. A stackable riser section as claimed in claim 39 wherein said vertical projections on said horizontal ledge are disposed midway between adjacent bosses and ribs of said riser section.

51. A stackable riser section as claimed in claim 40 wherein said vertical projections on said horizontal ledge are disposed midway between adjacent bosses and ribs of said riser section.

52. A stackable riser section as claimed in claim 41 wherein said vertical projections on said horizontal ledge are disposed midway between adjacent bosses and ribs of said riser section.

53. A stackable riser section as claimed in claim 43 wherein said vertical projections on said horizontal ledge are disposed midway between adjacent bosses and ribs of said riser section.

54. A stackable riser section as claimed in claim 44 wherein said vertical projections on said horizontal ledge are disposed midway between adjacent bosses and ribs of said riser section.

55. A stackable riser section as claimed in claim 45 wherein said vertical projections on said horizontal ledge are disposed midway between adjacent bosses and ribs of said riser section.

* * * * *